US005313900A

United States Patent [19]

Rendahl et al.

[11] Patent Number: 5,313,900

[45] Date of Patent: May 24, 1994

[54] FEED DIRECTION AND STITCH LENGTH CAM FOR ZIGZAG SEWING MACHINE

[75] Inventors: Karl I. F. Rendahl; Börje G. S. Törnqvist, both of Huskvarna, Sweden

[73] Assignee: Husqvarna Sewing Machines Aktiebolag, Sweden

[21] Appl. No.: 926,685

[22] Filed: Aug. 6, 1992

[30] Foreign Application Priority Data

Aug. 9, 1991 [SE] Sweden ..... 91023234

[51] Int. Cl.[5] ..... D05B 27/22; D05B 27/24

[52] U.S. Cl. ..... 112/316; 112/323

[58] Field of Search ..... 112/314, 315, 316, 317, 112/319, 320, 323, 324

[56] References Cited

U.S. PATENT DOCUMENTS

| | | | |
|---|---|---|---|
| 2,496,817 | 7/1950 | Schulthess | 112/210 |
| 2,526,480 | 10/1950 | Hohmann | 112/323 |
| 2,713,839 | 7/1955 | Engel | 112/323 |
| 4,391,216 | 7/1983 | Hsiao | 112/323 X |
| 4,512,273 | 4/1985 | Skogward | 112/315 |
| 4,559,887 | 12/1985 | Sand | 112/459 X |
| 4,756,263 | 7/1988 | Sand | 112/323 X |
| 4,848,254 | 7/1989 | Krowatchek et al. | 112/520 |

FOREIGN PATENT DOCUMENTS

| | | | |
|---|---|---|---|
| 0225185 | 12/1909 | Fed. Rep. of Germany . | |
| 634930 | 9/1936 | Fed. Rep. of Germany . | |
| 635599 | 9/1936 | Fed. Rep. of Germany . | |
| 635600 | 9/1936 | Fed. Rep. of Germany . | |
| 688508 | 2/1940 | Fed. Rep. of Germany . | |
| 2108309 | 5/1972 | Fed. Rep. of Germany . | |
| 0926213 | 9/1947 | France . | |
| 427938 | 5/1983 | Sweden . | |
| 0183578 | 8/1966 | U.S.S.R. | 112/323 |

*Primary Examiner*—Clifford D. Crowder
*Assistant Examiner*—Ismael Izaguirre
*Attorney, Agent, or Firm*—Pearne, Gordon, McCoy & Granger

[57] ABSTRACT

In a domestic sewing machine a feed dog (35) is adjustable for providing optionally selected stitch length and feeding direction and is adapted to be lowered to a position in which the feeding is inhibited. A control (15) is rotatably connected to a cam disk (16) adapted to adjust the feed dog to a selected position. The cam disk has positions corresponding to lowering of the feed dog as well as reversing the feeding direction, and a zone for controlling the stitch length. The control also has a conical portion (30) which in response to an axial movement of the control is adapted to provide a temporary reversal of the feeding direction.

5 Claims, 5 Drawing Sheets

FEED DIRECTION AND STITCH LENGTH CAM FOR ZIGZAG SEWING MACHINE

BACKGROUND OF THE INVENTION

1. Field of the Invention

The present invention relates to domestic sewing machines and more particularly to an arrangement for controlling the cloth feed dog of the machine.

2. Description of the Related Art

It is previously known in mechanical domestic sewing machines having a so-called coulisse for providing the movement of the cloth feed dog to combine the functions of the feed dog and the shuttle in a common module disposed at the outer end of the free arm of the machine. Such a module is known from U.S. Pat. No. 4,512,273. A function inherent in such known machines is the lowering of the feed dog for which a special control is provided. The lowering of the feed dog means that its function of feeding the workpiece is inhibited whereby the workpiece can be moved freely in all directions at the sewing position. In previously known machines the feed dog is provided with three controls for lowering, reversing, and stitch length, respectively. By combining these controls a number of components can be eliminated and a simple and clear control means can be provided.

SUMMARY OF THE INVENTION

The object of the invention is to provide actuating means for the three functions of a cloth feed dog, which means are manually adjustable to optionally selected positions by means of a single control. According to the invention, a stitch length control is provided with the functions of lowering the feed dog and reversing the feed direction by an extension of the range of adjustment of the control, and an axial movement of the same. The improved features obtained thereby are inherent in sewing machine provided with the arrangement as described below and in the claims.

BRIEF DESCRIPTION OF THE DRAWINGS

An embodiment of the arrangement according to the invention is described in the following with reference to the accompanying drawings, in which.

DETAILED DESCRIPTION OF THE PREFERRED EMBODIMENT

Figure 1:
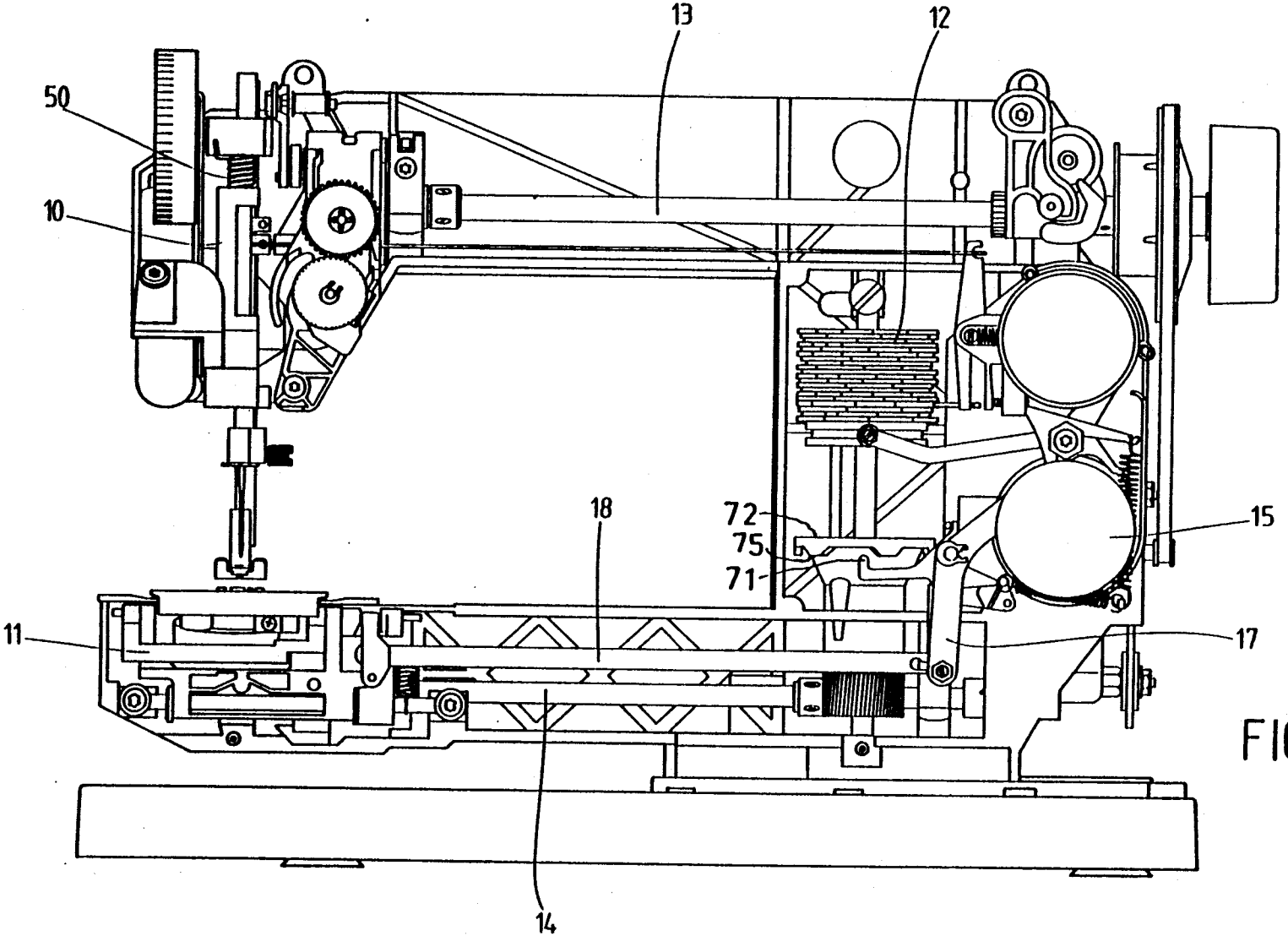
FIG. 1 is a front elevation of a sewing machine provided with the arrangement according to the invention.
Figure 2:
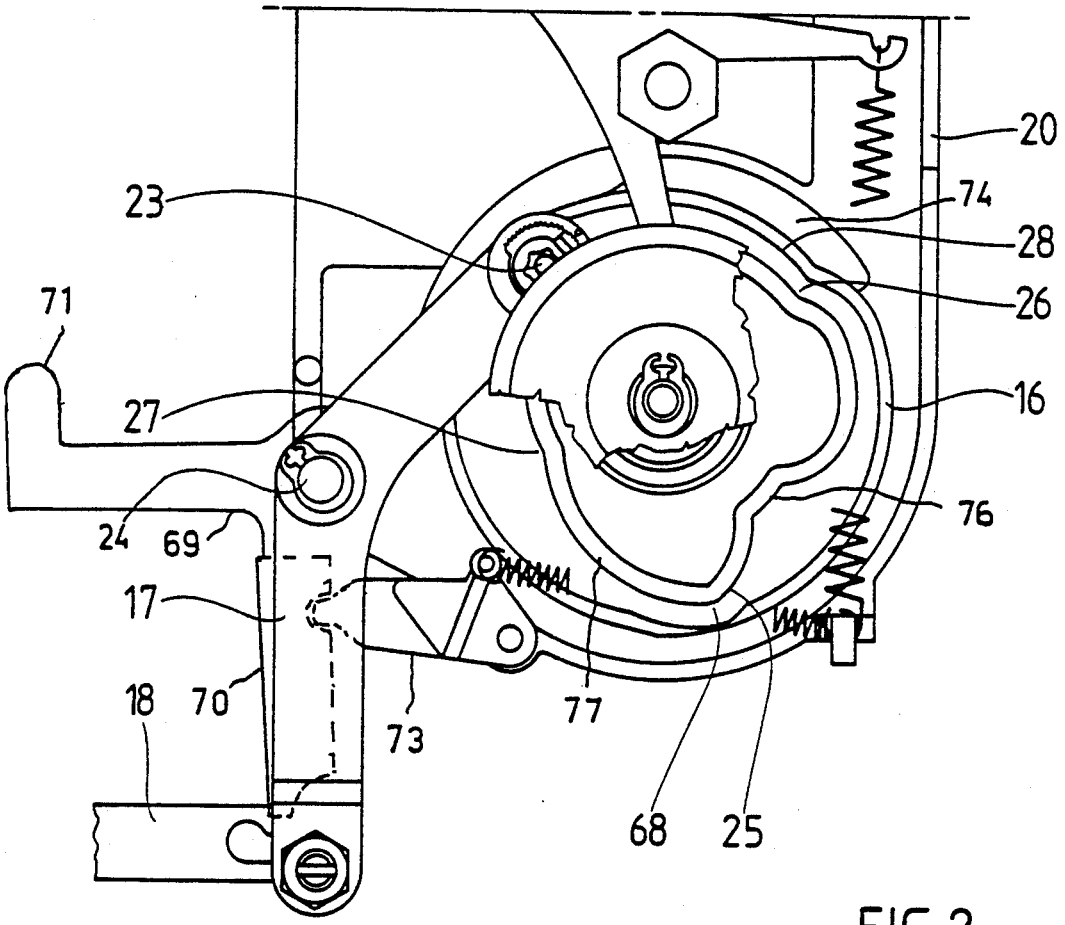
FIG. 2 is a front elevation of the feed control of the arrangement.
Figure 3:
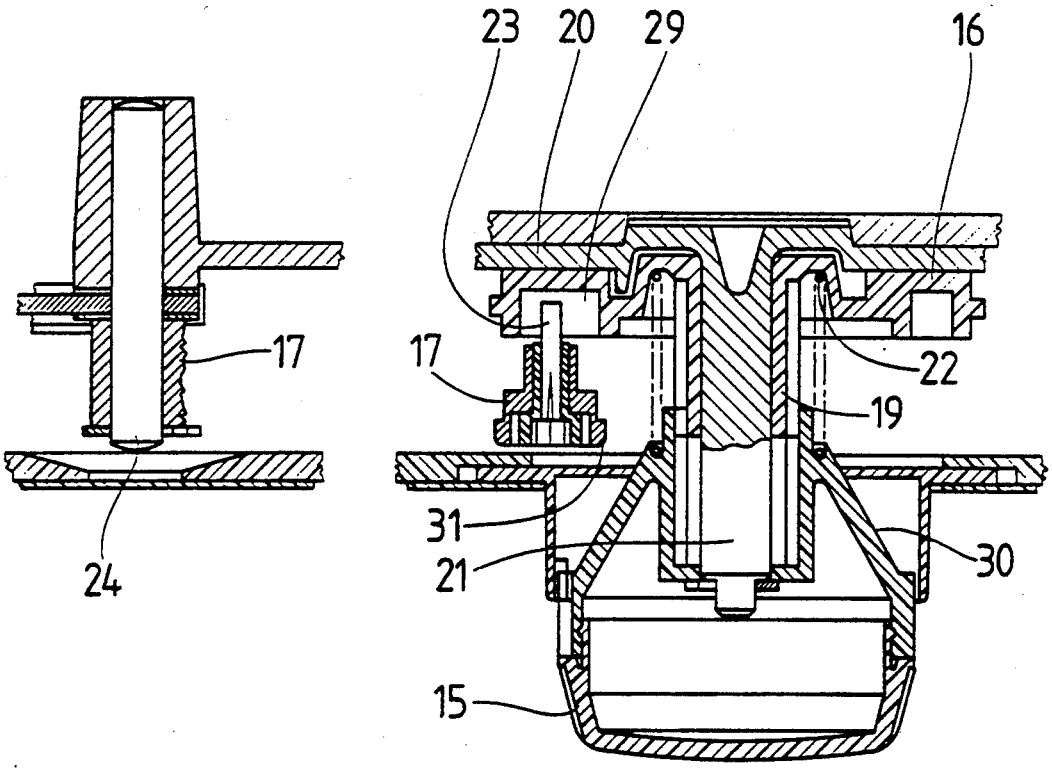
FIG. 3 is a horizontal section of the feed control.
Figure 4:
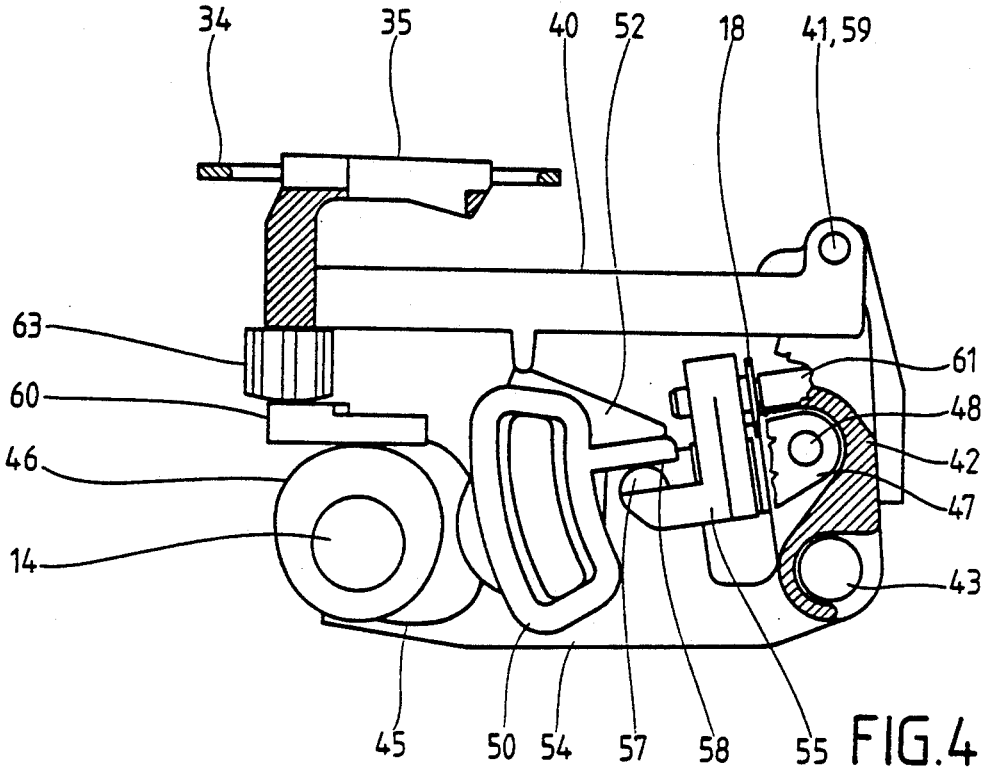
FIG. 4 is a partial section of a feed dog and drive means thereof provided at the end of the free arm of the machine.
Figure 5:
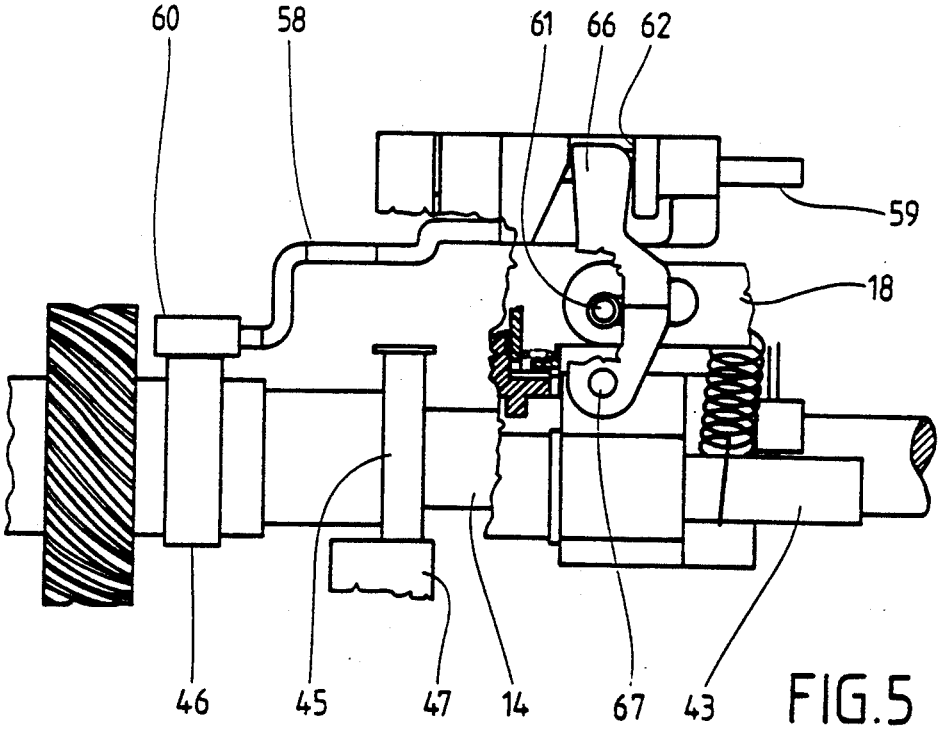
FIG. 5 is an elevation of the drive and actuating means of the feed dog.

The illustrated sewing machine is of the mechanical, cam controlled type, most parts of which are found in a conventional sewing machine, such as presser and needle bar unit 10, shuttle and feeding unit 11, zigzag control unit 12, and upper and lower drive shafts 13, 14.

The stitch length adjustment is performed by a control knob 15 which is connected to the actuating means of the feed mechanism via a cam disk 16, a lever 17 and a tension bar 18. The cam disk is journalled by means of a sleeve 19 on a shaft 21 attached to the body 20 of the machine. The knob is attached to the sleeve by means of splines in order to slide axially thereon and rotate therewith. The knob is held in its outer, shown position by a compression spring 22. The cam disk cooperates with a cam follower 23 which is actuated in a radial direction when the cam disk is adjusted to different angular positions by means of the knob. The cam follower is provided at the upper end of the lever 17, the other end of which is connected to the tension bar 18. It is rotated around its turning point 24 when the knob is rotated for adjustment thereof. The cam disk has a curve 25 which varies from a maximal radial distance 26 to a minimal radial distance 27. The various positions assumed by the cam follower due to rotation of the disk correspond to various stitch lengths and also different feed directions and are transmitted to the feeding mechanism via the tension bar 18.

A groove 29 of varying width is formed between the curve 25 and an outer rim 28, whereby the cam follower can move radially to a certain extent in this groove. The knob 15 is provided with a cone 30 by which the cam follower 23 can be actuated by pushing the knob inwards against the action of the spring 22. When the cone abuts the head 31 of the cam follower, the latter is pushed outwards in the groove 29, whereby the feeding direction is adjusted from forward to reverse. The reverse function which is common in sewing machines is thus inherent in the control knob.

Figure 6:
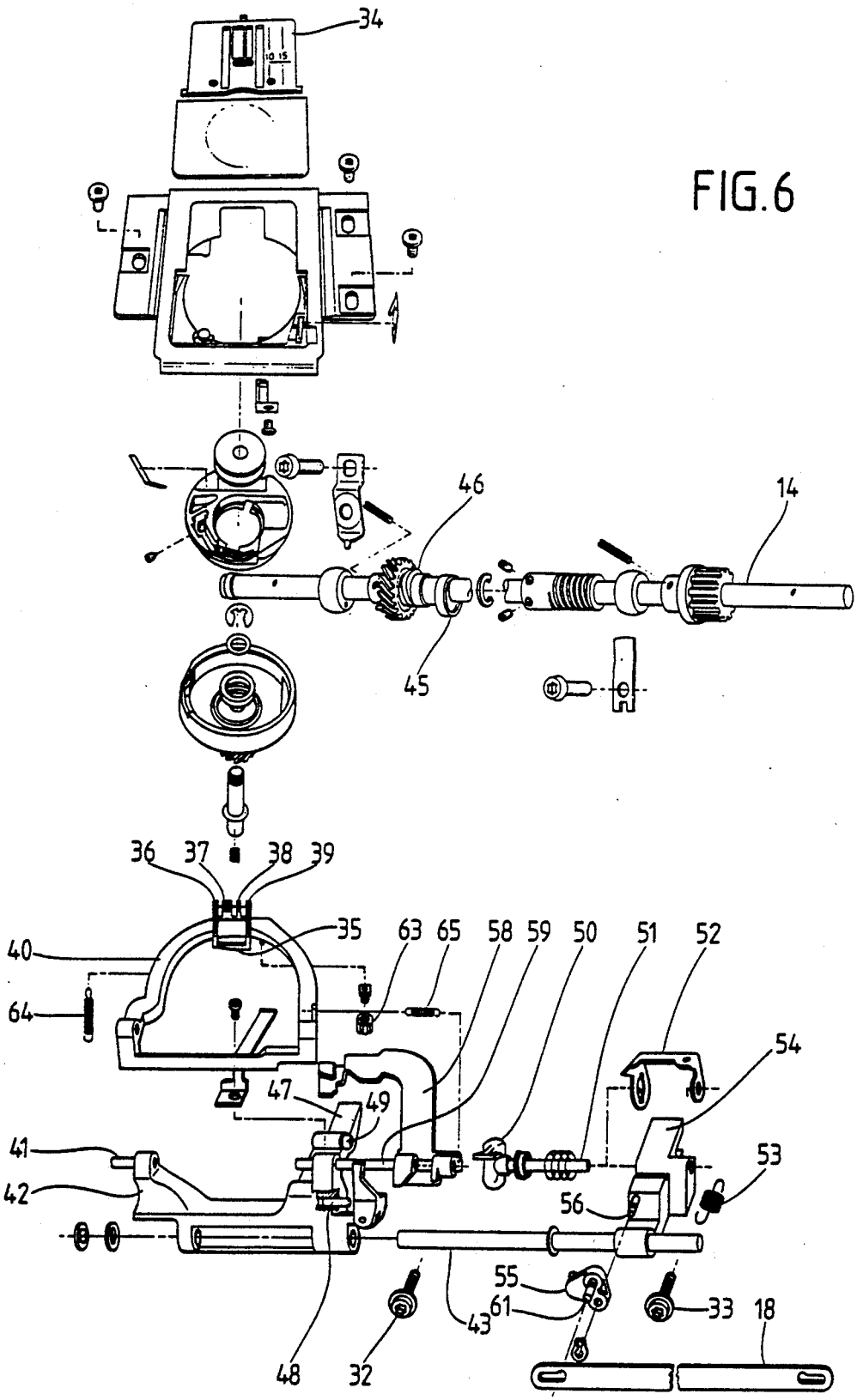
FIG. 6 is an exploded view of the feed and shuttle mechanism at the end of the free arm.

The feeding mechanism comprises the parts shown in the exploded view of FIG. 6. It is made as a module to be mounted in a space intended therefore in the free arm in which it is attached by means of a pair of screws 32, 33. On top of the mechanism is provided a needle plate 34 which is recessed into the working surface of the free arm. The cloth feed dog comprises a plate 35 having four rows of feeding teeth 36, 37, 38, 39, directed upwards and emerging through grooves in the needle plate.

The cloth feed dog is moved rectangularly in the usual manner and the horizontal portion of the movement is adjustable. The feed dog is attached to a bracket 40 which is journalled on shafts 41, 59, and a frame 42 which is rotatably journalled at its lower edge to a shaft 43. The driving of the feed movement is provided by the lower drive shaft 14 of the machine which has a pair of excenters 45, 46 attached thereto. The first excenter 45 actuates a fork-shaped slide 47 which is journalled to the frame 42 by means of a shaft 48. The fork is provided at its center portion with a pin 49 which forms part of a guide 50. The latter is attached to a shaft 51 which is journalled in the body 54 and has a lever 52 attaced to its end, said lever forming the point of engagement of a tension spring 53 which extends to the shaft 43 of the body 54. An adjusting means for the guide extends from the tension bar 18 and has the form of a joint lever 55 which is journalled at 56 to the body, and a sphere 57 engaging an abutment 58 of the guide. By means of the tension bar the guide can thus be rotated around the shaft 51 against the action of the spring 53 which constantly holds the abutment in contact with the sphere 57.

The movement of the pin in the guide is provided by the slide 47 which is caused to oscillate by the excenter 45. The pin reciprocates in the guide which is angularly adjusted relative to the slide whereby the latter is caused to reciprocate. This movement is transmitted via the frame 42 and the bracket 40 to the feed dog which is thereby actuated to move horizontally.

The extent of the vertical movement of the feed dog is generally constant and coordinated with the horizontal movement whereby the pattern of movement is approximatively rectangular. The bracket 40 is so elongated that only the rear portion thereof, to which the feed dog is attached, needs to perform its vertical movement in order to bring the teeth rows above and below the needle plate, respectively, during the various phases of the cloth feeding. The lifting movement of the bracket is provided by the excenter 46 via a rotatable and slidable carrier 58 which is journalled on the shaft 59 attached to the body. The carrier has an operative position in which a finger 60 thereof abuts the excenter and is oscillated thereby, and an inoperative position in which the finger is spaced from the excenter and the carrier is in a resting position. The adjustment between operative and inoperative positions of the carrier is provided by a pin 61 extending from the joint lever 55, a lever 66 having an axis of rotation 67, and an abutment 62 of the carrier. The range of operation of the tension bar 18 is extra large which provides such a large oscillation of the joint lever that the pin engages the abutment and displaces the carrier from its operative to its inoperative position. The bracket has a knob 63 disposed above the finger 60 and this knob is moved vertically by the finger. A spring 64 extending from the bracket to the body provides the downward movement of the bracket.

The extended movement of the tension bar is provided by the cam disc 16 in which the curve 25 has an extra high position 68. The control knob 15 is thereby provided with an additional function of lowering the feed dog which is obtained by setting the cam disk at this high position of the curve which moves the carrier to its inoperative position, whereby the feed dog is held below the needle plate. When the control knob is readjusted to feeding position, a tension spring 65 returns the carrier to its operative position.

The shaft 24 rotatably supports a joint lever 69 one arm of which is provided with a longitudinally slidable sleeve 70, and the other is provided with a cam follower 71 cooperating with an axially operating cam disk 72 provided on the shaft of the zigzag control unit 12. This arrangement is used for automatic control of the feeding direction, whereby seams including forward as well as reverse feeding can be sewn. The sleeve engages a rotatable cam follower 73 cooperating with a cam 74 of the cam disk 16. When the cam follower is actuated by this cam, which is provided by rotation of the control knob 15, the sleeve is pressed downwards into engagement with the tension bar 18 whereby guide knobs 75 of the cam disk 72 displace the guide 50 during rotation of the cam disk. In this phase the cam follower 23 is in a wider gap 76 of the cam disk 16 and can therefore follow the control movements of the tension bar freely. By the section 77 of the curve up to the highest point 68 the reverse feeding is steplessly adjustable.

In the above described embodiment several components can be replaced without departing from the scope of the invention as defined in the accompanying claims.

We claim:

1. Arrangement in a sewing machine provided with a cloth feed dog (35) which feed dog by drive means (45,46) is caused to move in a generally rectangular path and is adjustable for an optionally selected stitch length and feeding direction and provided with means for lowering to a position in which the feeding is inhibited, characterized in that the arrangement comprises a control means (15) rotatably connected to a cam disk (16) which operates actuating means to adjust the feed dog to selected positions, said cam disk having positions corresponding to lowering of the feed dog as well as reversing the feeding direction, and the cam disk also having a zone for controlling the stitch length, said control mean having a conical portion (30) which in response to an axial movement of the control means operates said actuating means to provide a temporary reversal of the feeding direction.

2. Arrangement according to claim 1, characterized in that the actuating means comprises a carrier (58) which is adjustable between operative and inoperative positions, said feed dog (35) remaining in its lowered position in said inoperative position of said carrier.

3. Arrangement according to clam 2, characterized in that the drive means for the vertical movement of the feed dog comprises an excenter (46) actuating said carrier (58) in its operative position.

4. Arrangement according to claim 3, characterized in that the carrier is movable relative to the excenter between its operative and inoperative positions and is adjustable between said positions by means of links (18,55) connected to displace the carrier.

5. Arrangement according to claim 1, characterized in that the control means (15) has a position in which automatic control of the feeding direction is applied by means of cams (74,76) and a cam follower (73).

* * * * *